US005618111A

United States Patent [19]

Porchia et al.

[11] Patent Number: 5,618,111

[45] Date of Patent: Apr. 8, 1997

[54] FLEXIBLE THERMOPLASTIC CONTAINERS HAVING VISUAL PATTERN THEREON

[75] Inventors: Jose Porchia, Midland, Mich.; Karen E. McBride, Indianapolis, Ind.; Brian C. Dais, Sanford, Mich.; D. Lyn Farrelly; Robert R. Steele, both of Indianapolis, Ind.

[73] Assignee: DowBrands L.P., Indianapolis, Ind.

[21] Appl. No.: 648,458

[22] Filed: May 15, 1996

Related U.S. Application Data

[63] Continuation of Ser. No. 355,744, Dec. 14, 1994, abandoned, which is a continuation of Ser. No. 84,654, Jun. 28, 1993, abandoned.

[51] Int. Cl.[6] ..... B65D 33/16; B65D 30/10

[52] U.S. Cl. ..... 383/63; 383/35; 383/105; 383/106

[58] Field of Search ..... 383/32, 35, 63, 383/65, 100, 101, 103, 105, 119, 106, 118, 903; 206/524.8, 459.1, 459.5

[56] References Cited

U.S. PATENT DOCUMENTS

| | | | |
|---|---|---|---|
| Re. 23,910 | 12/1954 | Smith et al. . | |
| D. 212,044 | 8/1968 | Woodman . | |
| D. 288,409 | 2/1987 | Mikkelsen . | |
| D. 297,307 | 8/1988 | Garber . | |
| D. 309,419 | 7/1990 | Berg . | |
| 1,793,163 | 2/1931 | Deubener . | |
| 2,538,920 | 1/1951 | Shumann | 383/106 |
| 2,774,402 | 12/1956 | Wikle | 383/102 |
| 2,778,173 | 1/1957 | Taunton . | |
| 3,054,148 | 9/1962 | Zimmerli . | |

(List continued on next page.)

FOREIGN PATENT DOCUMENTS

| | | | |
|---|---|---|---|
| 806005 | 2/1969 | Canada . | |
| 897921 | 4/1972 | Canada . | |
| 981636 | 1/1976 | Canada . | |
| 1027723 | 3/1978 | Canada . | |
| 1052968 | 4/1979 | Canada . | |
| 1125980 | 6/1982 | Canada . | |
| 1126462 | 6/1982 | Canada . | |
| 2016927 | 5/1990 | Canada . | |
| 2018390 | 6/1990 | Canada . | |
| 1269958 | 6/1990 | Canada . | |
| 2075940 | 2/1991 | Canada . | |
| 0089680 | of 1989 | European Pat. Off. . | |
| 1260772 | 4/1961 | France | 206/459.5 |
| 2421433 | 11/1975 | Germany | 383/119 |
| 3019224 | 1/1988 | Japan | 383/32 |
| 4267749 | 9/1992 | Japan | 383/105 |
| 1363721 | 8/1974 | United Kingdom . | |
| WO9014998 | 12/1990 | WIPO . | |

*Primary Examiner*—Jes F. Pascua

[57] ABSTRACT

A flexible container, and a process and apparatus for making the container having first and second sidewalls, side seams, a bottom edge, a top and an opening adjacent the top including the first and second sidewalls made from the same film web stock material, said web stock having at least a first visual pattern impressed thereon such that upon forming said first and second sidewalls from said web stock, said first and second sidewalls are adjacent to each other and at least a second visual pattern on the container different from the first visual pattern is perceived by an observer of the container.

15 Claims, 6 Drawing Sheets

U.S. PATENT DOCUMENTS

| | | | |
|---|---|---|---|
| 3,074,451 | 1/1963 | Whitney | 383/106 X |
| 3,137,746 | 6/1964 | Seymour et al. . | |
| 3,144,814 | 8/1964 | Lokey . | |
| 3,193,604 | 7/1965 | Mercer . | |
| 3,224,574 | 12/1965 | McConnell et al. . | |
| 3,286,005 | 11/1966 | Cook . | |
| 3,393,861 | 7/1968 | Clayton et al. . | |
| 3,411,698 | 11/1968 | Reynolds . | |
| 3,484,835 | 12/1969 | Trounstine et al. . | |
| 3,547,340 | 12/1970 | McDonald . | |
| 3,550,839 | 12/1970 | Clayton . | |
| 3,570,337 | 3/1971 | Morgan . | |
| 3,735,918 | 5/1973 | Tundermann | 383/32 |
| 3,738,565 | 6/1973 | Ackley et al. . | |
| 3,743,172 | 7/1973 | Ackley et al. . | |
| 3,744,384 | 7/1973 | Jarritt et al. . | |
| 3,760,940 | 9/1973 | Bustin . | |
| 3,832,267 | 8/1974 | Liu . | |
| 3,857,144 | 12/1974 | Bustin . | |
| 3,859,157 | 1/1975 | Morgan . | |
| 3,904,465 | 9/1975 | Haase et al. . | |
| 3,973,063 | 8/1976 | Clayton . | |
| 4,015,635 | 4/1977 | Göransson | 383/32 X |
| 4,132,594 | 1/1979 | Bank et al. | 383/102 X |
| 4,155,693 | 5/1979 | Raley . | |
| 4,157,237 | 6/1979 | Raley . | |
| 4,259,285 | 3/1981 | Baumgartl et al. . | |
| 4,315,963 | 2/1982 | Havens . | |
| 4,376,147 | 3/1983 | Byrne et al. . | |
| 4,456,639 | 6/1984 | Drower et al. . | |
| 4,486,363 | 12/1984 | Pricone et al. . | |
| 4,491,217 | 1/1985 | Weder et al. . | |
| 4,518,643 | 5/1985 | Francis . | |
| 4,546,029 | 10/1985 | Cancio et al. . | |
| 4,601,861 | 7/1986 | Pricone et al. . | |
| 4,658,433 | 4/1987 | Savicki . | |
| 4,678,457 | 7/1987 | Slobodkin . | |
| 4,698,052 | 10/1987 | Slobodkin . | |
| 4,709,400 | 11/1987 | Bruno | 383/63 X |
| 4,744,936 | 5/1988 | Bittner, Jr. . | |
| 4,810,451 | 3/1989 | Ermert et al. . | |
| 4,859,519 | 8/1989 | Cabe, Jr. et al. . | |
| 4,869,725 | 9/1989 | Schneider et al. | 383/63 X |
| 4,939,151 | 7/1990 | Bacehowski et al. | 383/102 X |
| 5,024,799 | 6/1991 | Harp et al. . | |
| 5,182,069 | 1/1993 | Wick . | |
| 5,259,904 | 11/1993 | Ausnit | 383/65 X |

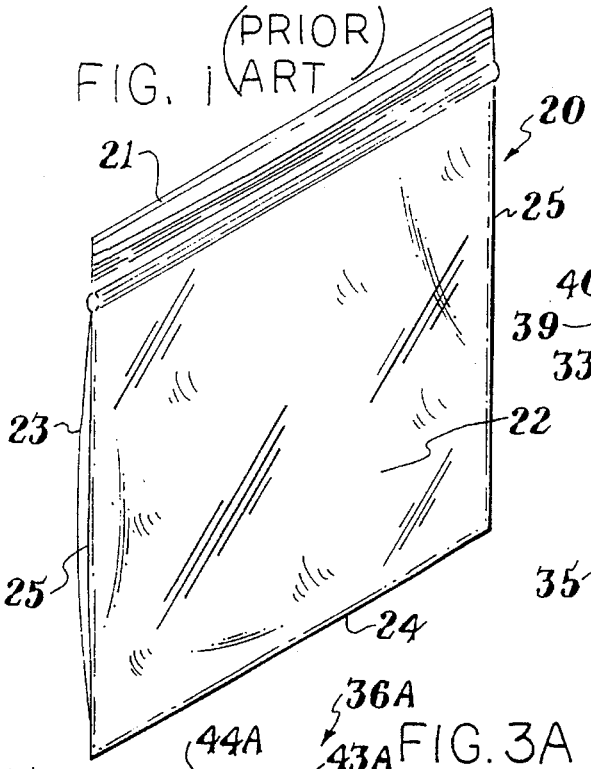
FIG. 1
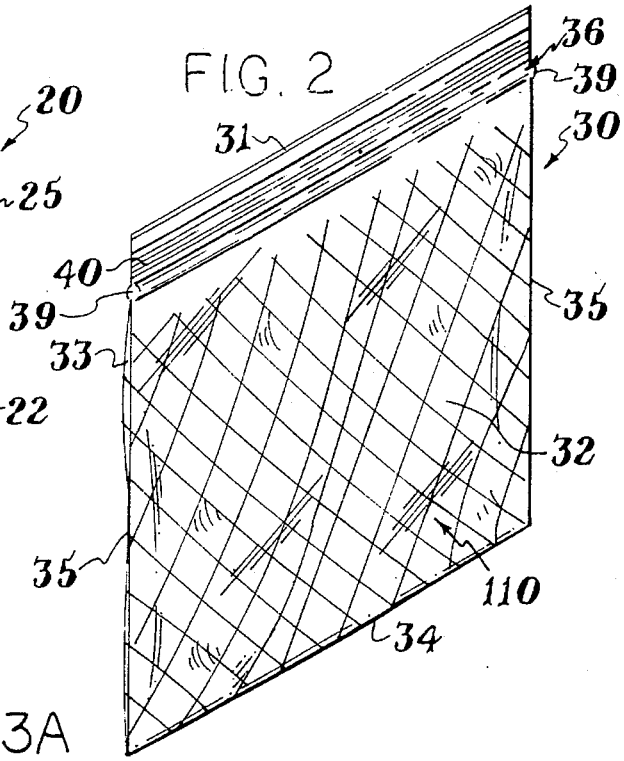
FIG. 2
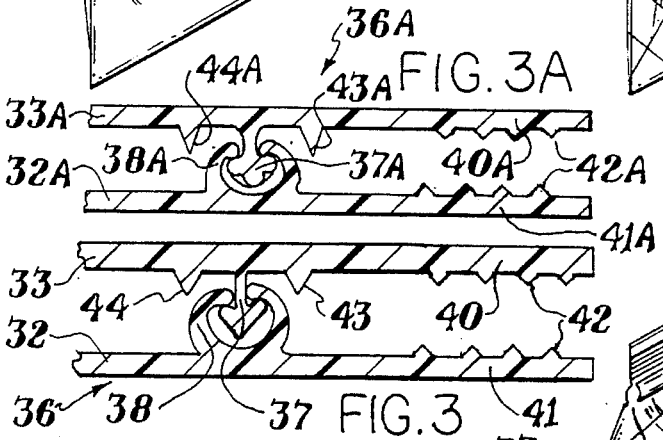
FIG. 3A
FIG. 3
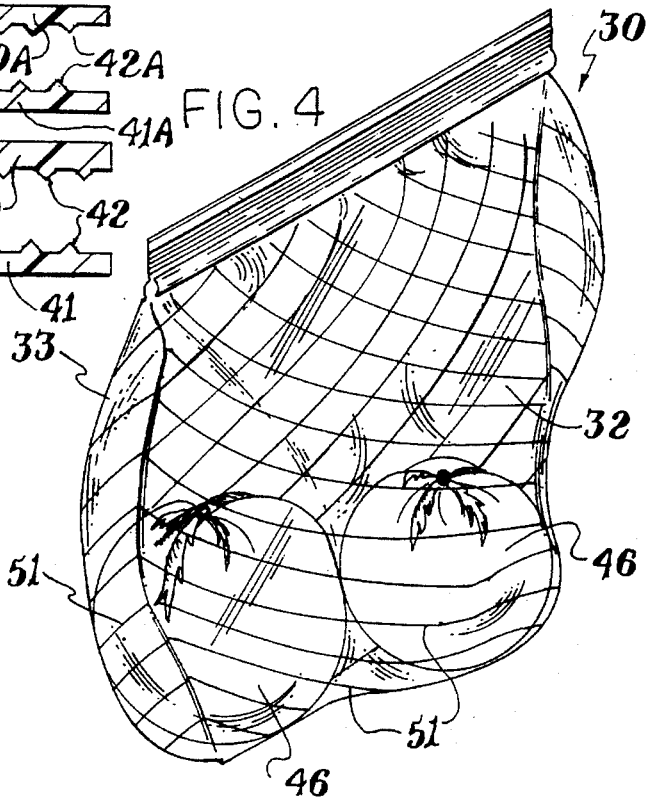
FIG. 4
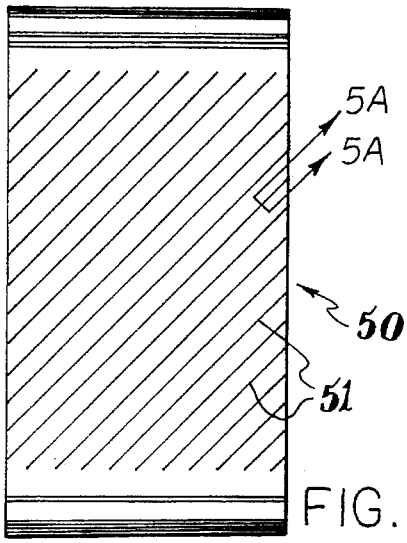
FIG. 5

FIG. 13
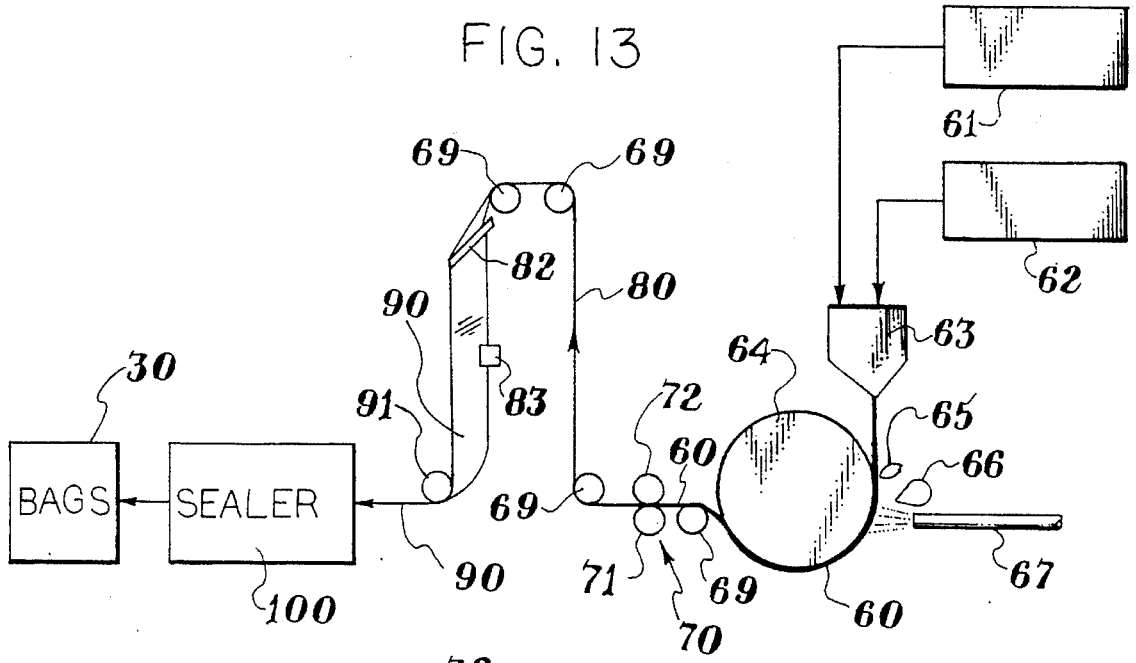
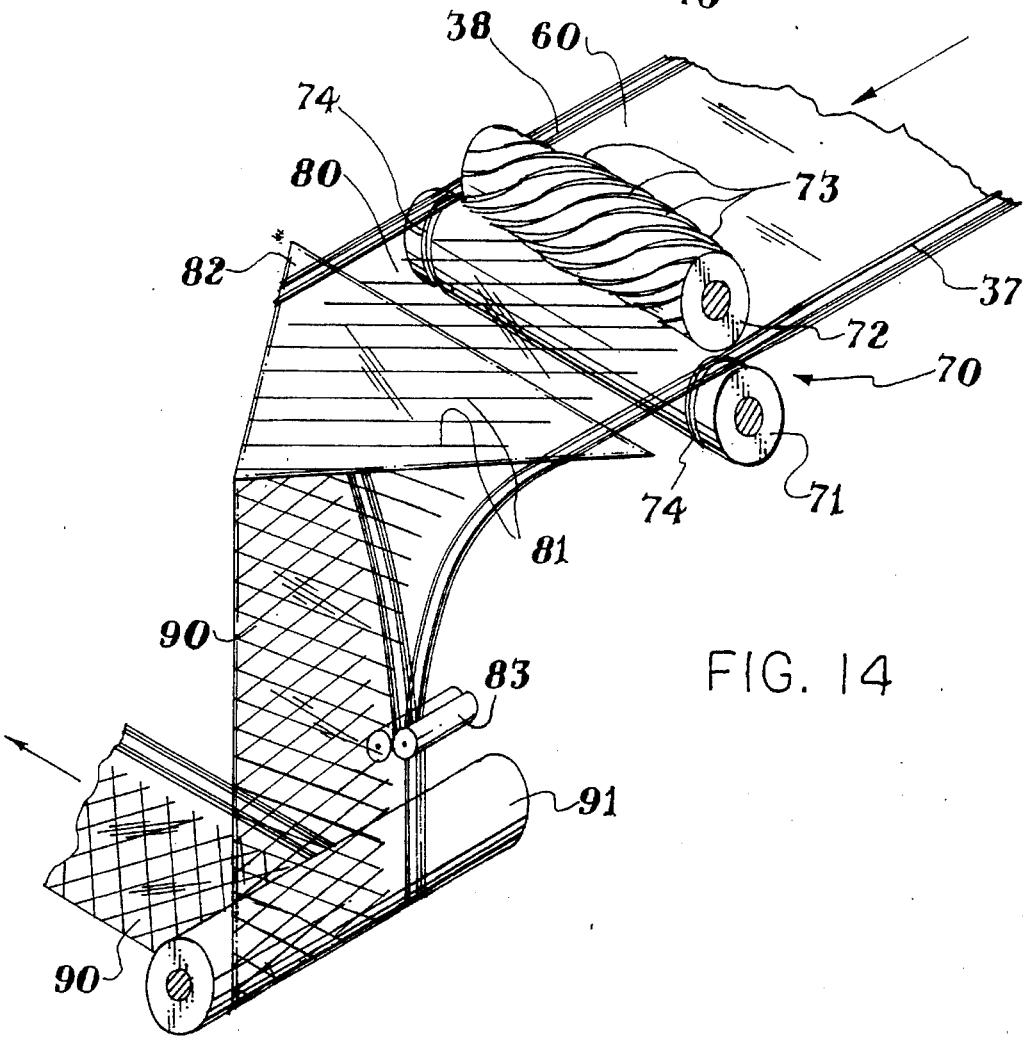
FIG. 14

FLEXIBLE THERMOPLASTIC CONTAINERS HAVING VISUAL PATTERN THEREON

CROSS-REFERENCE TO RELATED APPLICATION

This is a continuation of application Ser. No. 08/355,744, filed Dec. 4, 1994, now abandoned which is a continuation of application Ser. No. 08/084,654 filed Jun. 28, 1993 now abandoned.

BACKGROUND OF THE INVENTION

This invention relates to flexible thermoplastic bags or containers of the type having two flexible opposed sidewalls and, particularly, having fastener elements connected to the sidewalls of the container adjacent an open end of the container. More particularly, this invention relates to reclosable flexible thermoplastic bags or containers which feature an impressed pattern on the sidewalls of the bags or containers and preferably contain reclosable fasteners particularly an interlocking closure mechanism operable for being interlocked continuously over a predetermined length such as interlocking closure profiles.

It is well known in the industry to produce plastic bags or containers which feature reclosable fasteners of the type comprising interlocking closure profiles that are pressed together or pulled apart to seal or open the container. Several issued United States patents deal with processes and apparatuses for making reclosable plastic bags or containers. Representative of these patents, and of those dealing more specifically with closure mechanisms, are U. S. Pat. Nos. 4,186,786, 4,484,352, 4,755,248, 4,428,788, 4,419,159, Re. 28,969, 4,263,079, and 4,279,677. More particularly, a popular construction of a plastic bag and flexible fastener incorporates a pressure closable reopenable zipper type fastener comprising rib and groove elements.

The reclosable zipper type plastic bags generally are formed of flexible thin plastic film with front and back sidewalls with the sidewalls attached to each other along their sides seams and along a bottom edge. Adjacent the top edge and extending fully across opposed confronting inner surfaces of the mouth of the bag are a pair of cooperatively interlocking fastener strip profiles formed with respective engageable rib and groove elements made of extruded plastic material. Examples of such bags and means of manufacture thereof are disclosed in U.S. Pat. Nos. 3,198,228, 3,291,177, 3,338,284 and 3,340,116.

The reclosable zipper type plastic bags may be produced by having the zipper type rib and groove elements integrally produced with the bags or by first producing the zipper type elements as separate fastener strips which are subsequently attached to the top of the bags. In either instance, the zipper lock rib and groove elements normally are extruded and are interlocked during manufacture for convenience of storage and handling. The rib and groove elements then must be separated for filling or for use. Typically, there are flange members extending above the rib and groove elements which flange members are gripped and pulled apart to separate the rib and groove for access to the interior of the bag.

Generally, the reclosable plastic bag is made from a clear, smooth thermoplastic film web or sheet typically of a polyethylene resin material. Thus, the resulting bag product is generally a clear plastic bag having smooth sidewalls. The process of manufacturing thermoplastic bags or containers typically involves supplying a continuous web of the thermoplastic material which has been folded upon itself to form two plies. In forming individual bags, portions of the thermoplastic material are severed from the web. These severed areas become the side seams for the bags and are typically sealed at the same time as they are severed by the use of a heated wire element. Generally, the industry utilizes an extrusion die in which a closure profile of a thermoplastic resin is extruded and subsequently joined to the thermoplastic film web or sheet. Alternatively, the closure profile elements and sheet may be extruded as an integral unit from a single die whereupon the closure profile elements and sheet fuse to form an integral plastic container stock material.

Reclosable plastic bags of the general type described above have been in widespread use for a number of years, and find particular use for food storage purposes. While there are numerous patents issuing in the United States alone dealing with the manufacture of reclosable plastic containers and closure mechanisms therefor, the consumer of such bags is always ready for a new improved bag.

It is, therefore, desired to provide a bag or container stock material that can be impressed or embossed to form a pattern which will visually stand out to the casual observer.

It is further desired to provide a reclosable container or bag having interlocking fastening devices and a bag with a design pattern for visual enhancement providing a specific pattern when the bag is unfilled and providing another different pattern to provide a different visual effect when the bag is filled. The visual enhancement assists the user of the container in loading and unloading the container.

It is further desired to provide a process and apparatus for impressing a decorative pattern unto a plastic web stock used for making the plastic bags or containers.

SUMMARY OF THE INVENTION

One aspect of the present invention is directed to a container having first and second sidewalls, side seams, a bottom edge, a top and an opening adjacent the top comprising the first and second sidewalls made from she same film web stock material, the web stock having at least a first visual pattern impressed thereon such that upon forming the first and second sidewalls from the web stock the first and second sidewalls are adjacent to each other and at least a second visual pattern on the container different from the first visual pattern on the web stock is perceived by an observer of the container.

Another aspect of the present invention is directed to a container having first and second sidewalls, side seams, a bottom edge, a top, an opening adjacent the top and opposing interlocking profiles attached to the first and second sidewalls adjacent the top opening comprising:

a first sidewall with at least a first impressed pattern and a second sidewall with the same first impressed pattern such that when the two sidewalls are adjacent each other at least a second visual pattern is created.

Another aspect of the present invention is directed to a process for making a container having two sidewalls and opposing interlocking profiles comprising:

impressing a film web stock material with at least an initial first visual pattern; and forming the web stock into a container having first and second sidewalls adjacent each other such that the first sidewall has the first initial impressed pattern and the second sidewall has the first initial impressed pattern but with the two sidewalls adjacent each other the container as a whole has at least a second different visual pattern perceptible to the casual observer of the container.

BRIEF DESCRIPTION OF THE DRAWINGS

FIG. 1 is a perspective view of a transparent, closed and empty container of the prior art.

FIG. 2 is a perspective view of a transparent, closed and empty container in accordance with one embodiment of the present invention.

FIGS. 3 and 3A show different embodiments of occluded closure elements in cross-section suitable for use on the container of the present invention.

FIG. 4 is a perspective view of a transparent container which is closed and filled with non-clear material (e.g. tomatoes) in accordance with one embodiment of the present invention.

FIG. 5 shows a plan view of one embodiment of a web stock for making containers of the present invention.

FIGS. 6A–11A show partly cut away, front views of various embodiments of flexible containers made from the various web stocks of FIGS. 6–11, respectively.

FIG. 13 is a schematic illustration of an apparatus suitable for use in making the web stock of the present invention.

FIG. 14 is a perspective view of a portion of the apparatus shown in FIG. 13.

DETAILED DESCRIPTION OF THE PREFERRED EMBODIMENTS

Figure 5A:
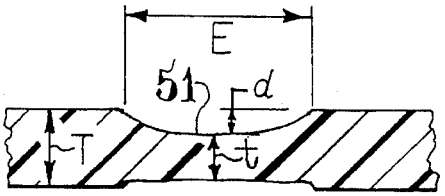
FIGS. 5A is a cross-sectional view taken along line 5A—5A of FIG. 5.

The present invention pertains to "clear", flexible thermoplastic bags or containers having two sidewalls with an impressed, engraved or scored pattern on the surface of the two sidewalls to provide an enhanced visual effect to the consumer or user of such bags or containers.

In its broadest scope, the present invention pertains to any flexible thermoplastic bag or container of any size or shape including trash bags and storage bags for food and non-food materials so long as the bags are of sufficient clarity for the present visual pattern feature of the present invention to function effectively. By "clear" it is meant that the bag is of sufficient transparency to allow a user of the bag to visually see through one sidewall of the bag to the other sidewall of the bag. The bags may be manufactured with or without fastener elements adjacent the bag opening. Herein the present invention will be described with reference to flexible thermoplastic bags of type described in U.S. Pat. No. 5,070,584 used for food storage.

In its broadest preferred form, the present invention comprises a thermoplastic bag having a reclosable end, first and second sidewalls, and a closure fastening device including first and second closure profiles positioned on respective first and second sidewalls and operable for being occluded and disengaged with respect to each other to close and open the bag, and wherein the bag features a pattern impressed on the surfaces of said first and second sidewalls of said reclosable bag. More specifically, the first and second sidewalls are attached to each other along three sides and interlocking first and second closure profiles are located near the edge of the fourth side forming the bag opening. The first and second closure profiles may be formed separately and then attached to the bag sidewalls as disclosed in U.S. Pat. No. 4,755,248, incorporated herein by reference, or the first and second closure profiles may be formed integral with the bag sidewalls, as disclosed in U.S. Pat. No. 4,736,496, incorporated herein by reference.

Generally speaking, the present invention comprises impressing at least one initial pattern on the film web stock material from which the above described bag is made such that when the final bag product is made with the first and second sidewalls, the sidewalls adjacent each other provide at least one visual pattern on bag different from the initial pattern on the film web which is perceivable to the bag consumer. The present invention improves the bag visually and the pattern on the bag indicates to a user whether the bag is loaded or unloaded. The scored or impressed pattern also functions as an indicator to the bag user by visually distinguishing the bag of the present invention from a "plain" clear bag of the prior art. Particularly, when the consumer desires to "dedicate" one type of bag, the patterned bag of the present invention or the "plain" clear bag, for a specific use and reuse, the consumer will not confuse the pattern bag with the "plain" bag for such use. This avoids contamination of specific fill material used in one bag over another type of bag when reusing the particular bag.

In addition, the patterns on the bag can be a mechanism to distinguish bags from each other and this distinction serves to communicate to a consumer that the particular pattern bag has various properties associated with that specific patterned bag without the consumer having to refer back to the package or writing the information on the bag itself. For example, a "plain" bag may have a certain thickness, made of a certain material, and be useful for a specific purpose such as sealed storage of food products. A patterned bag may have a film thickness greater than the "plain" bag and thus be useful for example as freezer application.

In instances where the "plain" bag might contain microperforations, the holes may not be visibly distinct to the casual observer, and thus, an impressed pattern on the microperforated bag may be useful to indicate to the consumer that the bag is microperforated. The consumer could readily distinguish an impressed pattern microperforated bag from a "plain" bag to avoid using a perforated bag when the consumer wishes to seal food products in a non-perforated bag or the consumer will not accidentally fill a bag having microholes with liquid. Various other indicator patterns impressed on the bag can be used on the bag to alert the bag user as will become apparent to those skilled in the art and intended to be covered by the present invention disclosed herein below.

FIG. 1 shows a perspective view of a typical transparent and empty thermoplastic container 20 with a reclosable opening 21 well known in the prior art. The container 20 has sidewalls 22 and 23 which are typically made of thin, flexible, transparent and smooth plastic film which has been folded along bottom edge 24 and heat sealed along vertical side edges 25 to define a pouch or bag 20.

A preferred embodiment of the container of the present invention is shown in FIG. 2. FIG. 2 shows a perspective view of a transparent and empty thermoplastic container 30 of the present invention with a reclosable opening 31. The container 30 has sidewalls 32 and 33 which are typically made of thin, flexible, transparent plastic film which has been folded along bottom edge 34 and heat sealed along vertical side edges 35 to define a pouch or bag 30. It can be seen from FIG. 2 that the use of transparent sidewalls 32 and 33 results in a visual recognition that the outer or inner surface on the sidewalls 32,33 of the bag 30 is altered. The altered surface of the sidewalls 32,33 will be described in more detail below.

The bag 30 of the present invention preferably includes a closure fastening device 36. The closure device 36 can be any type of closure but preferably is of the zipper type such as described in U.S. Pat. No. 5,070,584, incorporated herein by reference. While the bag 30 of the present invention does not require a zippered type closure feature, the preferred embodiment will be described in reference to these zippered type bags. One skilled in the art will recognize that the present invention is broader in scope than the examples provided herein below.

The closure device 36, more clearly shown in FIG. 3, includes rib type male and channel or groove type female closure profiles 37 and 38, respectively, which can be occluded and disengaged with respect to each other for closing and opening the bag 30. Closure profiles 37 and 38 are attached to the interior of sidewalls 32 and 33 along sidewall seal areas 39.

Bag 30 also preferably includes grasping flanges 40 and 41, shown in FIG. 3, with a grasping surface, in this instance grasping ribs 42 on the interior of grasping flanges 40 and 41 as described in U.S. Pat. No. 5,009,828, incorporated herein by reference.

The bag 30 may also preferably include the rib members 43 and 44, as shown in FIG. 3, referred to as "wide track" type rib members described in more detail in U.S. Pat. No. 4,736,486, incorporated herein by reference.

FIG. 3A shows another embodiment of a closure device of the present invention generally indicated as numeral 36A which includes rib type male and channel or groove type female closure profiles 37A and 38A, respectively, which can be occluded and disengaged with respect to each other for closing and opening the bag 30. In this embodiment, the closure profiles 37A and 38A which are attached to the interior of sidewalls 32A and 33A along sidewall seal areas 39A are those described in U.S. Pat. No. 5,070,584, incorporated herein by reference, which includes a deformed male profile 37A to provide an audible or clicking sound and/or a bumpy feel when the profiles are closed.

Referring to FIG. 2, again, a visual pattern, in this instance a diamond-shape pattern 110, is seen on the bag 30 by the casual observer. The diamond-shape pattern is a second different visual pattern than the initial pattern which was impressed on the web stock material used to the make the final bag product 30. In this instance, as shown in FIG. 5, a plurality of parallel diagonal lines 51 are impressed on a thermoplastic film web stock material 50 used to make the bag product 30 shown in FIG. 2. The web stock 50 becomes the sidewalls 32 and 33 of the bag 30. The initial impressed pattern, i.e., diagonal lines 51, once formed, are not physically altered before or after bag 30 is formed. In reality the impressed pattern is maintained in the sidewalls 32 and 33 of bag 30. However after bag 30 is formed, the perception to the casual observer of the bag is a second visual pattern different from the first impressed pattern.

The sidewalls 32 and 33 of bag 30 do not necessarily have to be contacting each other to provide the final visual effect or pattern, but can be near or adjacent each other when the bag 30 is empty (such as when the container is not in use and closed) or filled with clear materials such as water. However, when the sidewalls of the bag 30 are pulled apart or separated a substantial distance or a non-clear material intervenes between the two sidewalls (such as when the container is filled with food or pulled apart to open) the first initial impressed pattern is seen by a user of the bag.

As an illustration, when a bag of the present invention is filled with food or other non-food materials, particularly non-clear items such as vegetables like tomatoes 46 shown in FIG. 4, portions of the sidewalls 32 and 33 are separated and pulled apart by the vegetables such that the first initial impressed pattern, consisting of diagonal lines 51, on the each respective sidewall 32 and 33 is visually apparent, while those portions of the sidewalls 32 and 33 which remain adjacent to each other continue to provide the second visual pattern of diamond-shapes 110.

As aforementioned, the initial impressed pattern on the web stock material used to make the bag shown in FIGS. 2 and 4 is a series of parallel diagonal lines 51 impressed across the surface of the web stock as shown in FIG. 5. It will be apparent to one skilled in the art that many other initial patterns and variations of initial patterns may be impressed on web stock material used to make the bag of the present invention. All of the possible patterns which function in accordance with the present invention are intended to be covered by the present invention. A few examples of the impressed web stock materials are illustrated in FIGS. 6–11. The initial impressed patterns shown in FIGS. 6–11 can be used to make a bag product with a visual pattern shown in FIGS. 6A–11A, respectively, such as screen mesh, "x" pattern, dashes-to-solid lines, circles, squares and combinations thereof.

For example, FIG. 5 shows a single impressed uniform pattern on a web stock, i.e., diagonal lines, which is used to make a single uniform visual pattern, i.e., diamond shapes, on the bag produce shown in FIG. 2. However, it is contemplated to use a combination of two or more initial impressed patterns on a web stock to form only one uniform visual pattern on the bag product such as illustrated in FIG. 6 and FIG. 6A.

Figure 6:
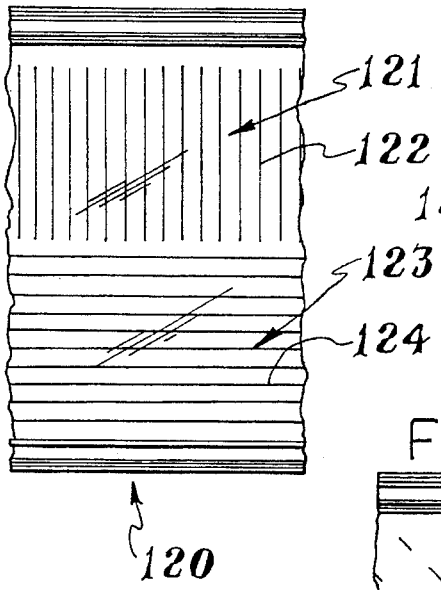
FIGS. 6–11 show front views of various embodiments of flexible web stocks useful for making containers of the present invention.
Figure 6A:
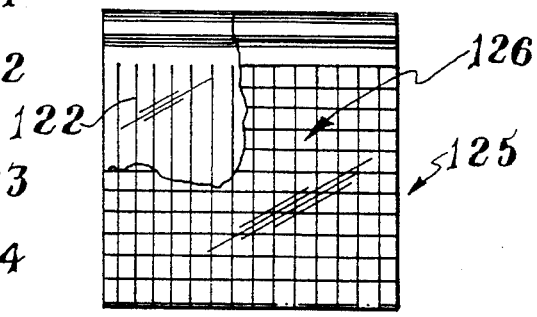

In FIG. 6, web 120 contains two impressed patterns, 121 and 123, comprising parallel lines 122 and 124, respectively, wherein lines 121 are perpendicular to lines 123. The web 120 may be manufactured by an impressing roll having the two patterns 121 and 124. The web 120 is used to make the bag product 125 of FIG. 6A having a single woven mesh visual pattern 126 consisting of a plurality of squares.

Figure 7:
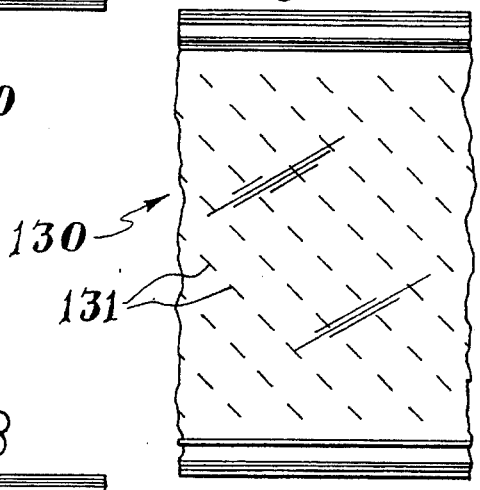
Figure 7A:
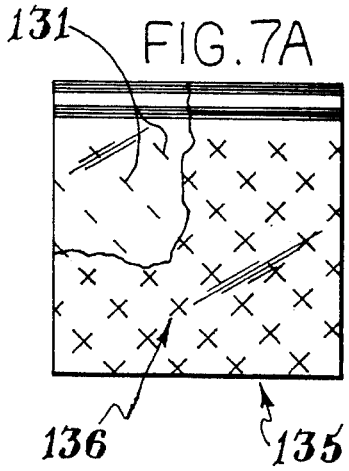

In FIG. 7, web 130 contains a single impressed pattern comprising impressed parallel, diagonal dashed lines 131. The web 130 is used to form the bag product 135 of FIG. 7A having a single visual pattern 136 consisting of a plurality of "Xs".

Figure 8:
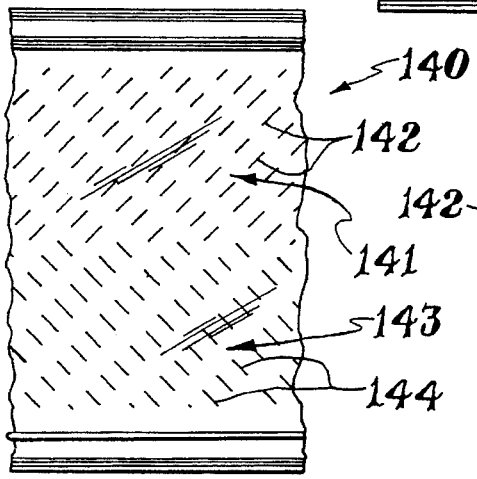
Figure 8A:
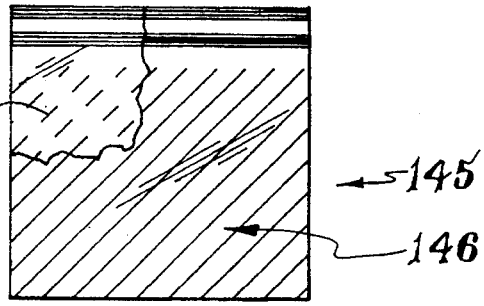

In FIG. 8, web 140 contains two impressed patterns 141 and 143 comprising diagonal, parallel dashed lines, 142 and 143, respectively at different angles. The web 140 is used to make the bag product 145 of FIG. 8A having a single visual pattern 146 consisting of parallel solid diagonal lines.

Figure 9:
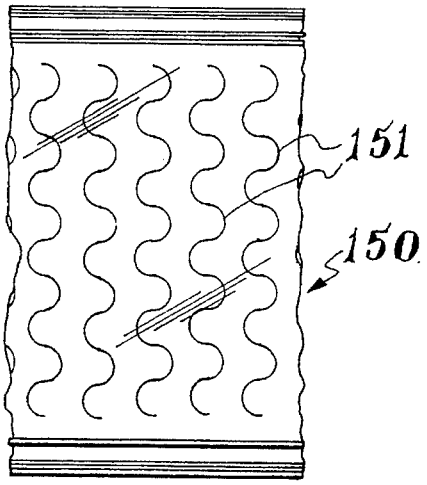
Figure 9A:
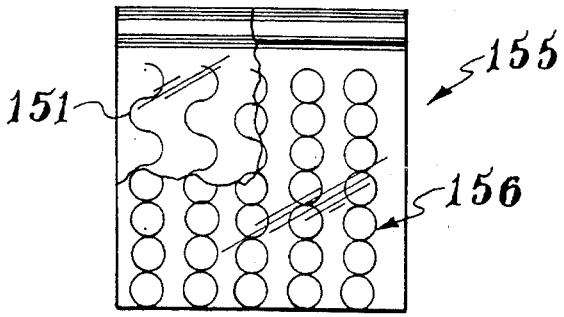

In FIG. 9, web 150 contains a single impressed pattern comprising parallel "wavy" lines 151. The web 150 is used to make the bag product 155 of FIG. 9A having a single visual pattern 156 consisting of a plurality of circles in parallel rows.

Figure 10:
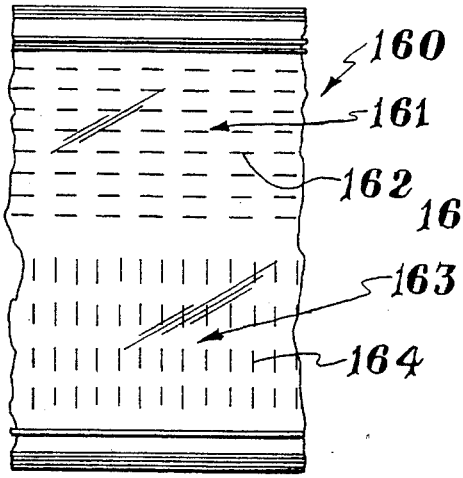
Figure 10A:
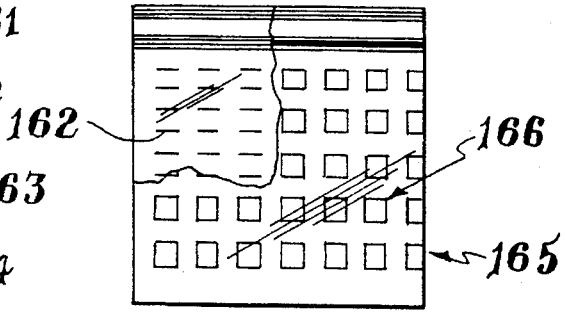

In FIG. 10, web 160 contains two impressed patterns 161 and 163 comprising horizontal and vertical dashed parallel lines 162 and 164, respectively. The web 160 is used to form the bag product 165 of FIG. 10A having a single visual pattern 166 consisting of a plurality of spaced apart squares.

Figure 11:
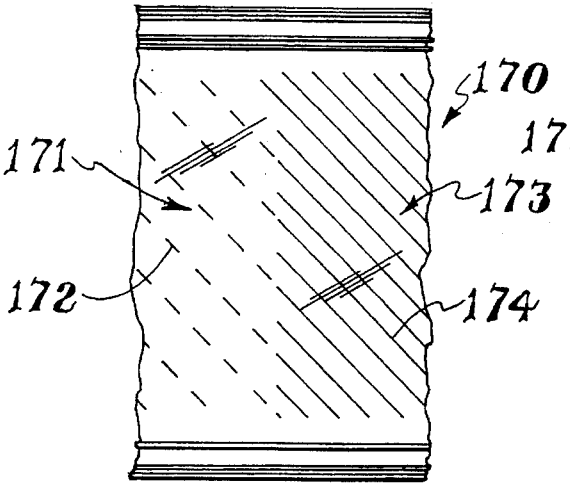

In FIG. 11, web 170 contains two impressed patterns 171 and 173. Patterns 171 comprises a series of diagonal parallel dashed lines 172 and patterns 173 comprises a series of solid diagonal parallel lines 174. The web 170 is used to form the bag product 175 of FIG. 11A having two visual patterns 176 and 177. Visual pattern 176 is a plurality of "Xs" and visual pattern 177 is plurality of diamond-shapes.

Referring again to FIG. 2, the second visual pattern 110 of the bag 30 (or any of the aforementioned patterns of FIGS. 6A–11A) is obtained after the bag 30 is produced by generally well known manufacturing processing steps. However, while typical processing steps are used to make the final bag 30 product of the present invention, the combined processing steps disclosed herein to make the novel bag 30 of the present invention has heretofore not been disclosed. Generally, the process of the present invention is carried out by first impressing a film web stock material with an initial pattern, preferably at least a single uniform pattern, and then folding the web stock to form the bottom of the bag and the sidewalls of the bags. The folded web stock is then sealed on its sides to form the side seams.

Figure 12A:
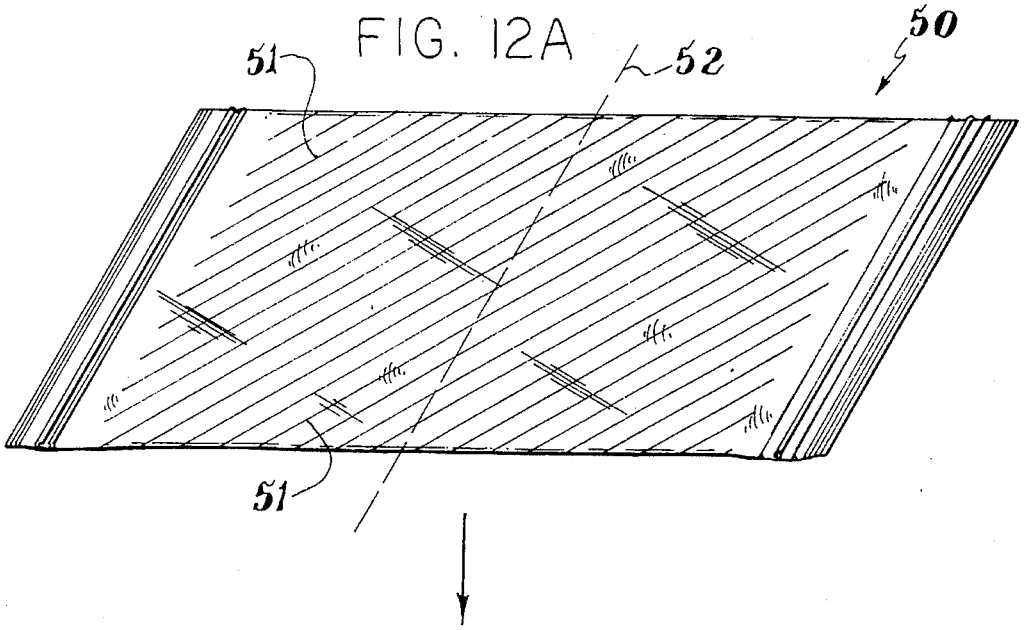
FIGS. 12A, 12B and 12C are a series of drawings illustrating the process of obtaining the desired pattern of the present invention by folding the web stock of FIG. 5.
Figure 12B:
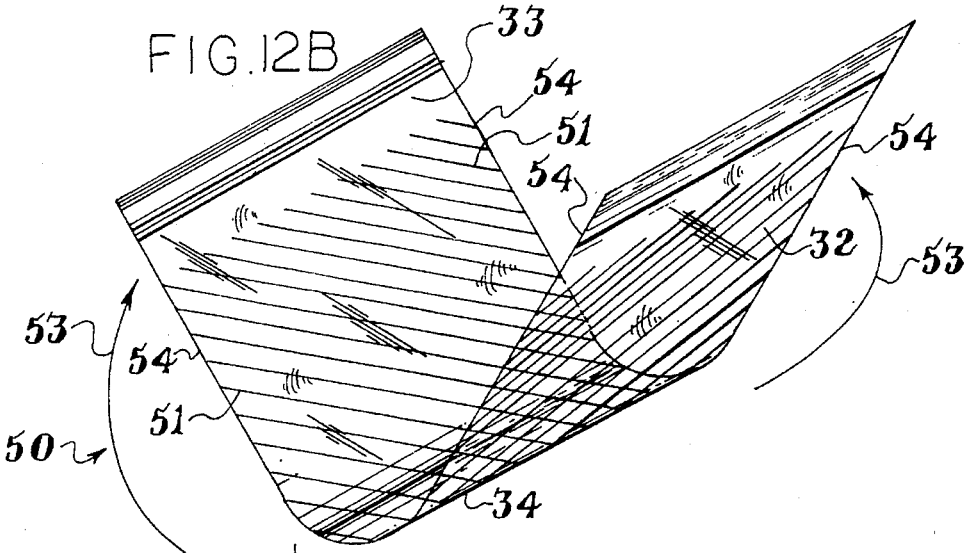
Figure 12C:
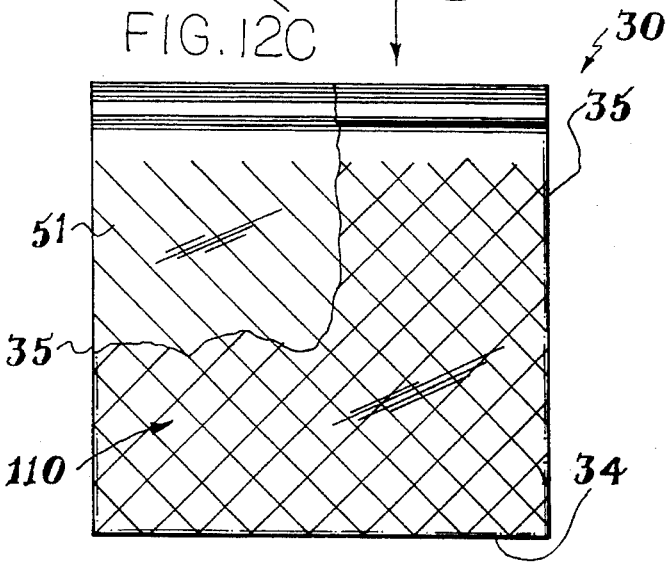

With reference to FIGS. 12A, 123 and 12C there is shown a series of general process steps for obtaining the second visual pattern 110 of the bag 30 of the present invention. FIG. 12A shows a film web stock which would be the bag film stock supply for feeding into a bag sealer for making the final bag product 30. In FIGS. 12A and 12B the web stock, in this instance the same web stock 50 shown in FIG. 5, is folded in half at a fold line 52 in the direction of the arrows 53 to obtain two sidewalls 32 and 33 and a bottom edge 34. The completed bag 30 shown in FIG. 12C is obtained upon sealing the edges 54 to form side seams 35 of the bag 30. In FIG. 12C, one corner of the bag 30 is shown cut away to illustrate that, in reality, he initial impressed diagonal lines 51 pattern is still present on both sidewalls 32,33 without change and that a diamond-shape or mesh pattern 110 is only perceivable to the observer of the final bag 30.

In carrying out the preferred process of the present invention a bag film stock supply for feeding into a bag sealer for making the final bag product 30 is first produced by attaching a closure device to a film web stock material. The film web stock materials and closure fastening devices employed in the present invention may be prepared by any suitable manufacturing method, such as by extrusion, by blow molding or other known methods of producing such film web stock materials and closure devices. The closure fastening device can be manufactured as a strip for later attachment to a film web stock material or the fastening device can be manufactured integral with the film web stock material. For example, U.S. Pat. No. 4,736,496 describes a preferred integral method and U.S. Pat. No. 4,755,248 describes the post-applied method. Generally, the present closure device can be made from a heat sealable material and then attached to a heat sealable film so that a container can be formed economically by heat sealing surfaces o form the container. It is preferred that an integral method for producing plastic film with occludable closure fused thereto be employed.

The dimensions of the container and the closure fastening device may vary in accordance with the intended use.

The containers and closure fastening devices employed in the present invention may be prepared from any suitable packaging material. Typical packaging materials include, for example, polymeric materials, preferably those such as polyethylene, polypropylene, polyvinyl chloride, polyvinyl acetate, polyamides, polyvinylidene chloride, and mixtures or copolymers thereof.

With reference to FIGS. 13 and 14 there is shown an apparatus and continuous process for making a bag 30 of the present invention. FIG. 13 shows a schematic view of the apparatus and process for preparing the bag 30 of the present invention. FIG. 14 is a perspective view, in more detail, of a portion of the apparatus and process shown in FIG. 13. FIG. 14 shows the portion of the apparatus of FIG. 13 that provides a scoring or impressing pattern onto a web stock and a fold in the web stock to obtain a bag stock supply for making bags in a subsequent sealing operation.

In FIG. 13, a film web stock 60 comprising an integrally fused closure member and film web is formed by first supplying a source of extrusion resin material (not shown) for the closure member and the film web member to extruders 61 and 62, respectively. The extruders 61 and 62 feed the resin into a die member 63 to coextrude the closure device and film web integrally as the closure device and film web exit the die 63 onto the surface of a chill roll 64. Air jets 65 and air knife 66 are used to assure good contact of the film and closure device fastener elements with the chill roll 64. The film 60 is pressed uniformly on the surface of the chill roll 64 by the air jets 65 and air knife 66. The air jets 65 above the air knife 66 pin the edges of the drawn film extrusion to the chill roll to reduce narrowing of the film and thickening of the film edge. Below the air knife 66 preferably are located water jets 67 which are aligned with each of the closure device fastener members to cool and shape the fastener members.

The closure integrally fused with the film web, herein web stock 60, is formed and chilled on the chill roll 64 and from the chill roll, the web stock 60 may go through a series of orientation, tension, nip and/or idler rolls 69 to direct the web stock 60 to pass through impressing equipment, generally indicated by numeral 70, wherein the web stock 60 is impressed with an initial impressed pattern. Preferably, the impressing equipment 70, in this instance, includes an anvil roll 71 and an impressing roll 72. The web stock 60 is passed in between the rolls 71 and 72 to form a film web stock with an impressed pattern thereon, indicated generally by numeral 80. The impressed web stock 80 is passed through an apparatus such as a folding plate 82 for folding the web stock 80 and an apparatus for joining the closure member profiles together such as occlusion rollers 83 to form a bag stock 90 which is ready for severing and sealing into individual bag products 30. The bag stock 90 is sent to a means for making the bag product or a bag sealing machine 100 well known in the art such as one described in U.S. Pat. No. 5,203,556.

The means for continuously scoring, engraving or impressing the surface of film web stock 60 useful for making a reclosable bag 30 is shown in more detail in FIG. 14. As shown in FIG. 14, the web stock 60 is provided with an impressed pattern in the area of the web stock which will eventually be the sidewalls surface areas of the reclosable bags of the present invention, the web stock 60 is fed between the nip of a pair of rollers 71 and 72 wherein at least one of the rollers 72 bears an impressing or engraving pattern thereon, in this instance ridges or protrusions 73, and one or both rollers have grooves 74 therein to accommodate the occludable profile elements 37, 38 of the interlocking fastener device to thus avoid damaging the occludable elements.

In FIG. 14 there is shown a web stock supply 60 (source not shown) being fed to the nip of two pull rollers 71 and 72 wherein one roller is a resilient rubber-backed roller 71 and one roller is a non-yielding impressing roller 72 having on its surface a series of ridges or other protrusions 73 to form on the surface of the film web an impressed pattern such as a series of diagonal lines 81 as shown in FIG. 14 (or diagonal lines 51 as shown in FIG. 5). Anvil roller 71 also has a peripheral groove 74, as shown in FIG. 14, located around its circumference to accommodate the closure profile element and to avoid damage to the closure profile.

Figure 11A:
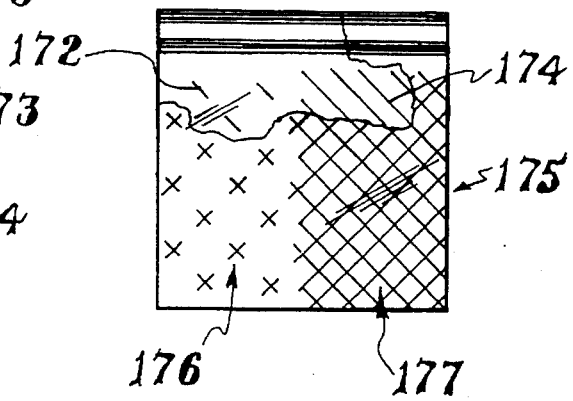

As shown in FIG. 14, web stock supply 60 is fed to the nip of rubber-backed roller 71 and impressing roller 72 whereby a single impressed pattern is produced on one side of the web stock supply 60. It is understood that the impressing roller 72 can be manufactured to contain any type and number of protrusions necessary to provide more than one impressing pattern or design on the surface of the web stock 60. For example, an impressing roller 72 can be made to accommodate two different impressed patterns or designs as shown in FIGS. 6, 8, 10 and 11. In one embodiment of the present invention, an impressing roller 72 may contain a protrusions to provide a single impressed pattern to the wed stock 60 that will provide another single visual pattern to the final bag product 30 as shown in FIG. 2. It is also contemplated in the present invention to provide an impressing roller 72 that will produce more than one pattern on the wed stock which, in turn, will provide (1) only one different visual pattern on the final bag product as shown in FIG. 6A or (2) more than one different visual patterns on the final bag product as shown in FIG. 11A.

The anvil roll 71 is made of any materials typically known to those skilled in the art and commonly used to make such rolls. The anvil roll can also be made of materials such as steel and silicon rubber. The hardness of the anvil roll should be sufficient to allow the impressing roll to provide or form a clearly visible and distinct score to the surface of the web stock. If the anvil roll is too soft the scoring will be too dull looking. If the anvil roll is too hard, the scoring may cut into the web film stock and the impressions will be uneven, the hardness of the anvil roll is preferably from about 40A Durometer hardness to about 65D Durometer hardness. More preferably from about 80A to about 65D.

The impressing roll 72 is made of any material typically known to those skilled in the art and commonly used to make such rolls such as steel. The impressing roll optionally may be coated for wear, resistance with, for example, a titanium nitrate coating. The impressing roll also includes the typical protrusions or raised portion 73 used to make the pattern on a web sheet, for example, ridges which can be made of various shapes, sizes, heights, spacings, sharpness, angles and thicknesses depending on the particular patterns desired.

Control of the impressing step and equipment includes, for example, controlling the gap between the impressing roll and anvil roll, the pressure or force placed on the impressing roll, temperature of impressing thickness of film. It is also important that the film web stock be uniformly flat across the anvil roll to provide a uniform impression on the web material without wrinkles or cuts through the web. FIG. 5A shows a cross section of the film with a single diagonal line impressed in the film with "T" being the thickness of the web stock film, "t" being the thickness of the film after it has been impressed with a line and "E" being the width of deformation of the film which visibly forms the diagonal line. The thickness "t" of the film, the depth "d" of the deformation and width of deformation "E" of the score line should not be so thin, deep and wide, respectively, so as to detrimentally effect the film properties, such as tensile modulus or tear strength of the film, yet sufficient to provide an impressed line to be visible.

Following the impressing step, the impressed web stock 80 is folded by known means such as a triangular member folding plate 82 and folding nip rollers (not shown). Following the folding step, the male and female closure elements on the web stock 80 may be occluded by passing the folded impressed web stock 80 through occlusion rollers 83. The occluded and folded impressed web stock is also the bag stock material 90 which will be used to make the final bag product 30. The bag stock material 90 is then directed by various idler, tension, or guide rollers 91 to a wind-up device (not shown) for storage, or is directed to further processing equipment such as a bag sealer 100 (FIG. 13) to manufacture bags.

With reference to FIG. 5, again, there is shown one embodiment of an embossing pattern on a web stock which essentially are parallel diagonal lines 51. With reference to FIG. 2, again there is shown one embodiment of a bag which was made from the embossed pattern web stock having parallel diagonal lines which were folded over on itself. As aforementioned, other embodiments are shown in FIGS. 6–11 and 6A–11A.

One preferred embodiment of the present invention is to use the impressing process with web stock used to make a vegetable bag such as the bag described in U.S. patent application Ser. No. 874,653 (Attorney Docket No. C-40, 071), filed Apr. 27, 1992 by Porchia et al., incorporated herein by reference. The above patent application discloses a vegetable bag with a plurality of microholes. A web stock containing a plurality of microholes can be produced in accordance with the teachings of the above patent and said microperforated web stock can then be impressed with a first visual pattern according to the present invention. The web stock with microperforations and impressed pattern can then be used to make a bag product such as shown in FIGS. 15 and 16.

Figure 15:
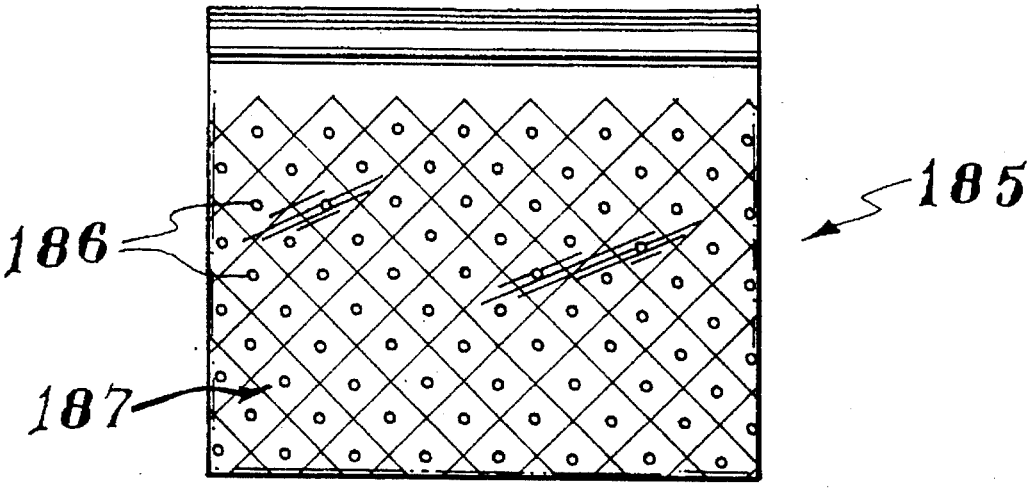
FIGS. 15 and 16 are front views of closed, empty containers in accordance with other embodiments of the present invention.
Figure 16:
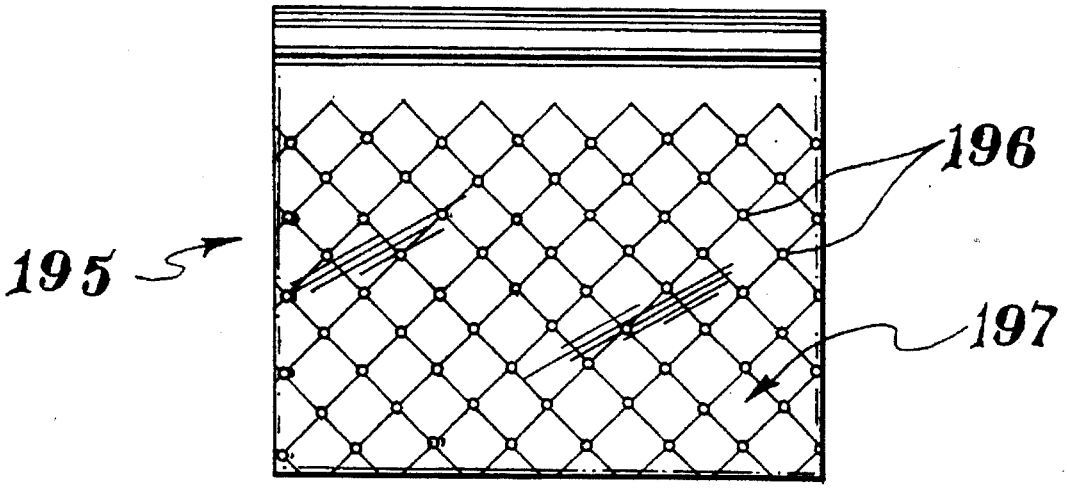

In FIGS. 15 and 16, there is shown a bag 185 and 195, respectively, with a combination of a plurality of microholes 186 and 196, respectively, and a visual pattern 187 and 197, respectively, in accordance with the present invention. The microholes 186, 196 can be randomly perforated in the film web material; or the microholes 186, 196 can be uniformly perforated in the film web in the pattern as shown in FIGS. 15 and 16. FIG. 15 shows the microholes centered in the diamond-shape pattern and FIG. 16 shows the microholes on the impressed diagonal lines. The microholes on the web stock can be made with microperforator machines, such as described in U.S. patent application Ser. No. 874,653 or U.S. patent application Ser. No. 938,061 (Attorney Docket No. C-40,759) filed Aug. 31, 1992 by Calligarich et al. The microholes can be made on the web stock prior to or after the impressing pattern is made on the web stock. For example, although not shown in FIG. 13, the microperforator machine can be used before or after the impressing equipment 70.

Although the present invention has been described in specific detail and by examples, this is not intended to be limitative of the scope of the claims below. Variations not specifically described that are within the spirit of the present invention are intended to be included in the scope of the claims. For example, other preferred embodiments of the reclosable bags of the present invention can be made featuring sidewalls of the reclosable container being either transparent, translucent or opaque and the scoring or impressing pattern being colored such that the colored pattern can be more easily recognized visually by a consumer or observer of the reclosable bag.

What is claimed is:

1. A container comprising a single clear film web sheet having a fold therein, said folded sheet having a bottom at said fold, a first sidewall and second sidewall, side seams and an open top defining a container, wherein the sheet has a first visual pattern scored or impressed into said film sheet such that the same said first visual pattern is on the first sidewall and the second sidewall, said first sidewall and second sidewall being adjacent to each other, thereby bringing the first visual pattern on the first sidewall in juxtaposition with the first visual pattern on the second sidewall in a non-mirror image configuration, whereby the container has a distinct second visual pattern different from the first visual pattern visible through each of the sidewalls of the containers.

2. The container of claim 1 including a reclosable fastener adjacent the top of the container.

3. The container of claim 2 wherein the reclosable fastener adjacent the top of the container comprises a pair of cooperatively interlocking fastener strip profiles formed with respective engageable rib and groove elements extending fully across opposed confronting inner surfaces of the opening of the container.

4. The container of claim 1 wherein the first initial visual pattern is at least one uniform pattern throughout the substantially entire surface of the first and second sidewalls.

5. The container of claim 1 wherein the second different visual pattern on the container results from a combination of at least two different first initial visual patterns on the surface of the first and second sidewalls.

6. The container of claim 1 wherein at least two different second visual patterns on the container results from a combination of at least two different first initial visual patterns on the surface of the first and second sidewalls.

7. The container of claim 1 including a plurality of microholes through the sidewalls of the container.

8. The container of claim 1 wherein the first initial visual pattern is a plurality of parallel diagonal lines.

9. The container of claim 8, wherein the first initial visual pattern on the first sidewall is a plurality of parallel diagonal lines angled in one direction and the first initial visual pattern on the second sidewall is a plurality of parallel diagonal lines angled in the opposite direction of the first sidewall.

10. The container of claim 1 wherein the first initial visual pattern is colored.

11. The container of claim 1 wherein the second visual pattern is mesh-like.

12. The container of claim 1 wherein the second visual pattern is diamond shape.

13. A container comprising first and second sidewalls side seams, a bottom edge, a top, an opening adjacent the top and opposing interlocking profiles attached to said first and second sidewalls adjacent the top opening said first and second sidewalls formed from a single film web sheet folded onto itself, the first sidewall with a first visual pattern scored or impressed into said sidewall and the second sidewall with a visual pattern substantially identical to the first scored or impressed pattern such that when the two sidewalls are brought into substantial contact with each other or adjacent each other a different second visual pattern is created.

14. A reclosable plastic container formed from a single film web sheet comprising a front sidewall and a back sidewall with side seams, a bottom and a top with interlocking fasteners, said front and back sidewalls containing scored or impressed markings forming at least a first initial visual pattern such that when the front and back sidewalls are adjacent each other and such that when an intervening substantially nontransparent material is placed between the sidewalls and the front and back sidewalls are separated by the intervening substantially nontransparent material the existing first pattern on the sidewalls is visually formed, and such that when an intervening substantially nontransparent material is not placed between the sidewalls and the front and back sidewalls are not separated by the intervening substantially nontransparent material at least a second visual pattern different from the first visual pattern is visually formed, thereby providing an indication of when the container is loaded or unloaded.

15. The container of claim 14 wherein the first pattern formed is a plurality of parallel diagonal lines and the second pattern formed is a plurality of diamond-shapes.

* * * * *